US005335649A

United States Patent [19]

Randall et al.

[11] Patent Number: 5,335,649

[45] Date of Patent: Aug. 9, 1994

[54] STRETCHING DEVICE

[76] Inventors: John N. Randall, 2906 Ambleside, Richardson, Tex. 75082; James R. Wooley, 20896 Paseo Roble; William H. Fagan, 26451 Sandy Creek, both of El Toro, Calif. 92630

[21] Appl. No.: 637,921

[22] Filed: Jan. 7, 1991

Related U.S. Application Data

[63] Continuation of Ser. No. 320,116, Mar. 7, 1989, abandoned.

[51] Int. Cl.[5] ..... A61H 1/02

[52] U.S. Cl. ..... 601/24; 482/1; 482/133; 602/19; 601/27; 601/33; 601/35

[58] Field of Search ..... 272/125, 129, 130, 134, 272/123; 128/24 R, 25 R, 77, 78, 80 R, 80 C, 80 F, 80 G, 87 R, 88; 482/1-9, 92, 112-113, 133-138; 602/16, 19-29

[56] References Cited

U.S. PATENT DOCUMENTS

| | | | |
|---|---|---|---|
| Re. 16,653 | 6/1927 | Evins | 128/73 |
| 2,202,187 | 5/1940 | Chalette | 128/25 R |
| 2,387,966 | 10/1945 | Zander | 128/25 R |
| 2,598,204 | 5/1952 | Allen | 128/74 |
| 3,060,926 | 10/1962 | May | 128/25 R |
| 4,253,662 | 3/1981 | Podolak | 272/123 |
| 4,282,865 | 8/1981 | Pogue | 128/25 R |
| 4,325,547 | 4/1982 | Cook . | |
| 4,445,684 | 5/1984 | Ruff . | |
| 4,456,247 | 6/1984 | Ehrenfried . | |
| 4,492,222 | 1/1985 | Hajianpour | 128/25 R |
| 4,509,509 | 4/1985 | Bouvet et al. | 128/25 R X |
| 4,520,804 | 6/1985 | DiGeorge . | |
| 4,558,692 | 12/1985 | Greiner | 128/25 R |
| 4,566,440 | 1/1986 | Berner et al. | 128/25 R |
| 4,577,623 | 3/1986 | Pecheux | 128/25 R |
| 4,601,468 | 7/1986 | Bond et al. | 272/143 X |
| 4,621,620 | 11/1986 | Anderson . | |
| 4,625,960 | 12/1986 | Gvioch et al. . | |
| 4,635,932 | 1/1987 | Dewees . | |
| 4,635,933 | 1/1987 | Schnell | 272/129 |
| 4,665,899 | 5/1987 | Farris et al. | 128/25 R |
| 4,669,450 | 6/1987 | Lindberg . | |
| 4,669,451 | 6/1987 | Blauth et al. | 128/78 X |
| 4,671,257 | 6/1987 | Kaiser et al. | 128/25 |
| 4,678,187 | 7/1987 | Prsala . | |
| 4,730,829 | 3/1988 | Carlson | 272/129 |
| 4,753,438 | 6/1988 | Paris et al. . | |
| 4,772,015 | 9/1988 | Carlson et al. | 272/129 X |
| 4,773,398 | 9/1988 | Tatom | 128/25 R |
| 4,781,373 | 11/1988 | Irwin . | |
| 4,798,197 | 1/1989 | Nippoldt et al. | 128/25 R |
| 4,826,158 | 5/1989 | Fields, Jr. . | |
| 4,834,073 | 5/1989 | Bledsoe et al. | 128/25 R X |
| 4,877,239 | 10/1989 | Dela Rosa . | |
| 4,905,677 | 3/1990 | Pecheux | 128/25 R |
| 4,915,378 | 4/1990 | Abrahamian et al. . | |
| 4,930,497 | 6/1990 | Saringer | 128/25 R |
| 4,936,299 | 6/1990 | Erlandson | 128/25 R |
| 4,949,960 | 8/1990 | Harlan . | |

FOREIGN PATENT DOCUMENTS

| | | | |
|---|---|---|---|
| 3501963 | 7/1986 | Fed. Rep. of Germany | 128/25 R |

OTHER PUBLICATIONS

Sutter 9000; Jan. 1985.

*Primary Examiner*—Jennifer Doyle

[57] ABSTRACT

A proprioceptive neuromuscular facilitation exercise device including a drive motor, gear mechanism connected with the drive motor, a control connected with the motor for operating the motor in either direction, and a rotating member connected with the gear mechanism and adapted to be coupled to a body member of a user for moving the body member in the desired direction. The movable member moves in increments and is lockable at desired positions for holding the body member against a force tending to return it to normal position or a force in the opposite direction. One exercise device rotates the upper torso relative to the spine. Another of the exercise devices rotates the upper legs of a user relative to the hip joints and lower legs relative to the knees. A further device operates the arms forward and backward relative to the shoulder joint and includes parallel vertical shafts movable together and apart to adjust for difference distances between the shoulder joints of a user.

11 Claims, 8 Drawing Sheets

STRETCHING DEVICE

This application is a continuation of application Ser. No. 320,116, filed Mar. 7, 1989, now abandoned.

FIELD OF THE INVENTION

This invention relates to exercise and physical therapy devices and more particulary relates to exercise and physical therapy devices employing the techniques of proprioceptive neuromuscular facilitation, more commonly known and referred to hereinafter as PNF.

BACKGROUND OF THE INVENTION

The background of the invention and its operation will be better understood with the following definitions in mind: Agonist—those muscles which normally contract for a given body movement; Antagonist—those muscles which normally elongate (stretch) for a given body movement; Isometric contraction-contraction of muscles where no body movement takes place.

Flexibility, the ability to move one's limbs and trunk freely through a wide range of motion, is important to the well being of all people. In simple terms a human motion is accomplished by contraction of one muscle group (henceforth called the agonist muscle group) to pull a body part in a given direction and the commensurate elongation or relaxation of an opposing muscle group (from now on referred to as the antagonist muscle group). Limited flexibility is usually the result of lack of strengthening the agonist muscle group and/or tense or shortened antagonist muscles. In normal healthy humans the limiting factor is usually the antagonist's inability to relax and stretch further.

The importance of flexibility has been particularly stressed by sports medicine experts as essential to athletic performance and the prevention of injuries. Various methods of stretching to increase flexibility have been investigated.. The method of ballistic stretching such as when one continually bobs up and down in an attempt to touch one's toes, has the disadvantage that the antagonist muscles (hamstrings and low back muscles ) have a difficult time elongating since they are called upon to contract (in order to reverse the direction of motion) at the limit of the stretch when they should be relaxing. Another disadvantage of the ballistic stretching technique is that the force involved with the motion has the potential of over stretching the antagonist muscles and injuring them.

A different method called static stretching has advantages over ballistic stretching. This technique involves a slow steady motion until the point of maximum stretch is obtained and this position is held for a period of time. The principle advantage is that the antagonist muscles are permitted to relax.

A still more effective method of increasing flexibility is achieved by employing the techniques of PNF. PNF is a large body of physical therapy techniques which utilize the actions of a therapist in conjunction with the patient to stimulate the patient's muscles to achieve a desired result. The PNF techniques were developed for paralytic patients at the Kabot-Kaiser Institute in Vallejo, Calif. A standard text on PNF techniques is "Proprioceptive Neuromuscular Facilitation, Patterns and Techniques" by M. Knott and D. E. Voss, published in 1956 by Hoeber and Harper of New York.

Modified PNF techniques for stretching have evolved from the traditional PNF techniques. These modified PNF stretching techniques have been shown in a number of studies to be superior to ballistic and static methods in achieving greater range of motion.

A specific example of PNF techniques applied to stretching is given using hip flexion as an example. The patient lies on his/her back with one leg resting on the ground. With the held of a therapist the patient raises the other leg (without bending the knee) toward his/her chest and continues in that direction until the antagonist muscle group (low back & hamstring) is stretched to the point that further motion would result in pain. At this point further motion (without pain) of the leg toward the chest can only be accomplished by the relaxation of the antagonist muscles.

One way to get muscles to relax is to stimulate them by hard contraction for a few seconds then release the tension. With the therapist's help the patient while at the limit of his stretch can contract the antagonist muscles (hamstring and low back) in an attempt to try to push his leg away from the chest in the opposite direction of the stretch. The therapist's role is to assure that the patient cannot move his leg away from his chest. This is referred to as isometric muscle contraction (meaning without motion). Some skill is required on the therapist's part to resist the motion without forcing the leg back towards the chest and possibly injuring the patient. After a few seconds of isometric contraction the natural relaxation response of the antagonists will allow the patient with the therapist's help to move the leg closer to the chest stretching further than he could previously.

At this new limit to stretch, the sequence can be repeated and perhaps repeated once more. Dramatic improvements in flexibility are readily obtained. These PNF stretching techniques are being taught by leading sports medicine figures to athletes wishing to improve their flexibility and along with it their athletic performance and resistance to injuries.

The PNF stretching technique described above involves the isometric contraction of the antagonist muscle group. According to the principles of PNF, however, there is also benefit to be gained from isometrically contracting the agonist muscle group (those muscles when contracted would move toward a greater degree of stretch) while at the limit of stretch. This effect can be understood in simple terms. As stated previously, any motion is accomplished by contraction of agonist muscles and relaxation of antagonist muscles. Therefore, the contraction of the agonist will naturally lead to the relaxation of the antagonist. However, for an unaided human at the limit of stretch, further contraction of the agonist will lead to painful elongation of the antagonist muscles. If the patient can contract the agonist muscles against a restraining force or structure, this isometric contraction will be accomplished without motion or the accompanying pain involved with further elongation of the antagonist muscles. This action facilitates the relaxation of the antagonist muscles.

The technique of isometrically contracting both the antagonist and the agonist sequentially at the limit of stretch, while extremely effective, is difficult to execute. While a therapist may successfully block the motion in either direction of a severely impaired individual, this is much more difficult to accomplish with a normal healthy patient. It is often difficult to completely block the attempted motion in one direction and much more difficult to be expected to restrain motion in the opposite direction. For this reason, most PNF stretching shown to athletes has been restricted to contraction of only the antagonist muscles at the limit of stretch, as described above.

A number of prior patents show various devices used to perform a variety of exercise routines. U.S. Pat. No. 3,285,070 shows a device for evaluating muscular strength and exercising. The device rigidly locks a body part at a given position. The user then attempts to move the body part and means are provided for measuring the effort applied. U.S. Pat. No. 3,233,366 shows a device for exercising involving either isotonic or isometric muscular contractions. U.S. Pat. No. 3,424,005 shows a device for isometric exercises with an indicator to signal the amount of force applied to a bar. U.S. Pat. No. 3,465,592 is an apparatus for isometric muscular exercises in which a body part movement is initiated by the user and may then be resisted by the device. U.S. Pat. No. 3,989,240 shows a power exerciser having power driven belts which extends and retracts to provide active physical exercise and passive body movement during physiotherapy. U.S. Pat. No. 4,478,411 shows a system for body exercises in which the body movement is resisted by weights that are raised and lowered. U.S. Pat. No. 4,669,450 shows an exercise device for operation by a foot of the user to apply a stretching force to a heel cord including mechanism for locking the foot board at a desired angular relationship to a leg board to maintain the application of a stretching force for desired period of time. U.S. Pat. No. 4,702,108 shows an apparatus and method for isometric muscle strength testing. U.S. Pat. No. 4,456,247 shows a leg stretching device for forcing the legs apart. None of such prior art patents are understood to show devices capable of performing the functions of applicant's invention.

Some equipment has been designed to exercise flexibility such as the devices described in the above mentioned U.S. Pat. Nos. 4,669,450 and 4,456,247. In all known cases these machines are not designed with PNF techniques in mind. They are designed to mechanically aid the user to achieve their limit of stretch and maintain that position. On some of the equipment the isometric contraction of the antagonist muscles could be performed, though in no cases does the literature of these machines suggest this action. In no case do these instruments allow the isometric contracting of the agonist muscles.

There also exist some machines which have been designed to test isometric strength which do provide rigid restraints against contracting of opposing muscle groups such as the devices described in the above mentioned U.S. Pat. Nos. 3,285,070 and 4,702,108. In these cases however, there is no provision for user controlled motion for stretching.

SUMMARY OF THE INVENTION

The present invention involves the mechanization of the PNF stretching techniques. The invention is a device which allows a user to stretch a given body part to the limit of stretch with which the user is comfortable. The device provides rigid barriers against which the user may contract sequentially the antagonist and the agonist muscle groups. The facilitated relaxation of the antagonist allows the user to move the device under the user's control in small increments to a greater degree of stretch where the process of contraction of the two muscle groups may be repeated. The device permits the process to be repeated several times. The device includes a feature permitting the user to release the restraints on motion so that if at any time the user feels excessive discomfort the mechanism may be immediately released to allow the body part to move to a comfortable position. A variety of embodiments of the device of the present invention permit different body parts to be exercised by the PNF technique. It is particularly important that the devices of invention permit a user to perform PNF stretching exercises without the aid of another person, and additionally, the machines are able to implement PNF stretching techniques more fully and effectively than possible with the use of a human physical therapist.

The exercise machine of the invention allows an individual to increase flexibility by employing stretching techniques based upon the principles of PNF. The basic principles upon which the exercise machine is designed include the following. The user is placed in a biomechanically sound position. Adjustments are permitted to accommodate different size users and to assure alignment of the axis or axes of rotation of the machine with those of the body parts of the user. Means are provided for coupling the body part of user to the exercise machine including restraints where necessary to assure body motion is restricted to isolate the exercise to a particular muscle group. User control of the mechanism is provided to permit and/or aid the user in moving the body part or parts in small increments in the desired direction. Rigid restraints are provided that the user may push against, both in the direction of stretch and in the opposite direction for isometric contraction of both antagonist and agonist muscles. A release mechanism operated by the user is provided to allow unrestrained motion. The mechanism includes a readout showing the user the degree of stretch obtained. A readout may be provided of the force of the isometric contractions which would be useful in determining the strength curve of an individual and gauging progress of injured muscles.

The simplest form of an exercising device incorporating the features of the invention includes: a motor coupled with a gear box driving a shaft connected with a worm drive which meshes with a worm gear connected with a member rotatable about the axis of the worm gear to which the body part to be exercised may be coupled. The motor is operated by a motor controller by which the user of the exercise device may control the movement of the member to which the body part is coupled. Another embodiment of the simplest form of the exercise device includes an electromechanical clutch connected from a drive shaft driven by the worm gear to a shaft driving the member coupled with the body part. The electromechanical clutch is connected with a safety switch accessible to the user for stopping the driven member in the event the control to the motor fails. The exercise device may be made for single axis rotation, multiple independent axes rotation, and multiple coordinated axes operation.

BRIEF DESCRIPTION OF THE DRAWINGS

The objects and advantages and preferred embodiments of exercise devices constructed in accordance with the invention will be better understood from the following detailed description taken in conjunction with the accompanying drawings wherein:

FIGS. 6A–8 schematically illustrate the drive mechanism for an exercise device in accordance with the invention including parallel spaced axes of rotation wherein the spacing between the axes is adjustable;

FIG. 6A is a side view in elevation of the axes adjustment mechanism of the device shown in FIGS. 6A–8;

FIG. 8 is a side view of the assembly of the devices of FIGS. 6A and 7A;

DESCRIPTION OF PREFERRED EMBODIMENTS

Figure 1:
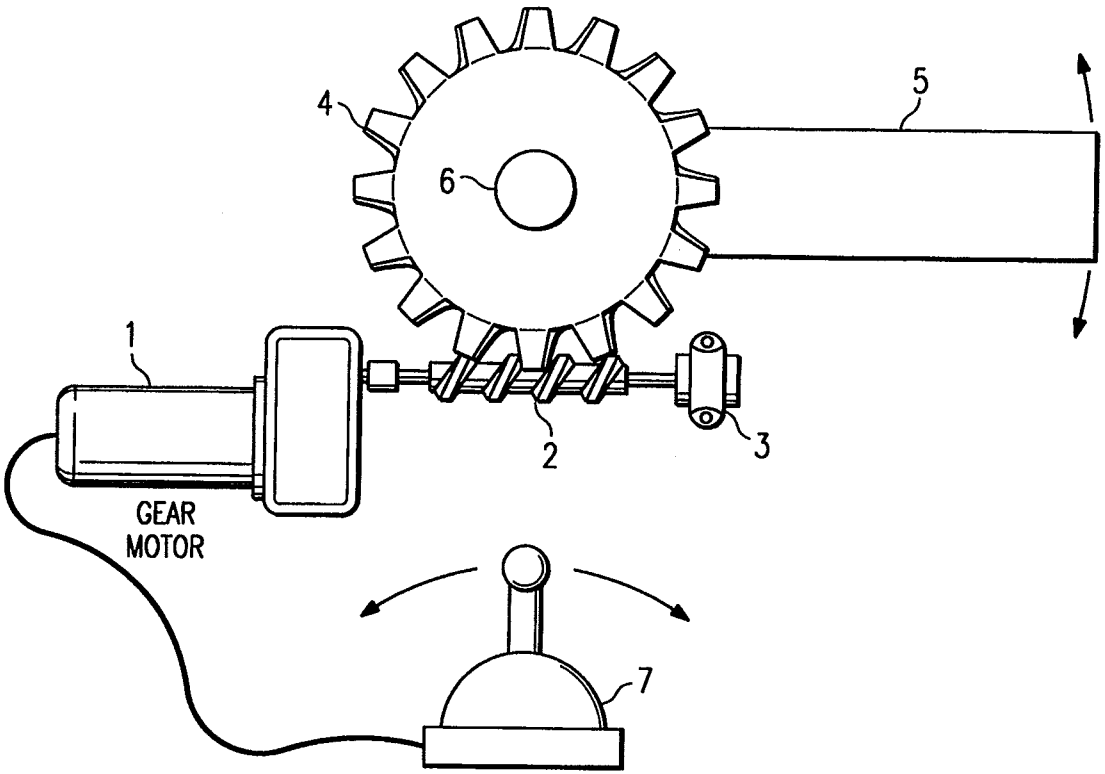
FIG. 1 is a schematic representation of the basic elements in the various embodiments of the invention.

Referring to FIG. 1, a basic form of exercise device in accordance with the invention includes a gear motor 1 comprising an electric motor with an associate gear box having an output shaft supporting a worm drive 2 connected at one end into a bearing 3. The worm drive 2 meshes with a worm gear 4 which is connected to the member 5 by a shaft 6 about which the worm gear 4 and member 5 rotate. The gear motor 1 is connected with a motor controller 7 which operates the gear motor at the desired speed and direction by the user of the device. An arm, leg, or other body member of the user is coupled with the member 5 in any suitable manner such as by the grasping of the member 5 by the hand of the user so that the users arm may be moved in the desired direction by the member 5 as the worm gear rotates on the shaft 6. The user may control the extent which the arm may be moved by the motor controller 7. Because of the high degree of mechanical reduction in the worm gear and gear motor, when the motor is stopped the member is effectively locked in place.

Figure 2:
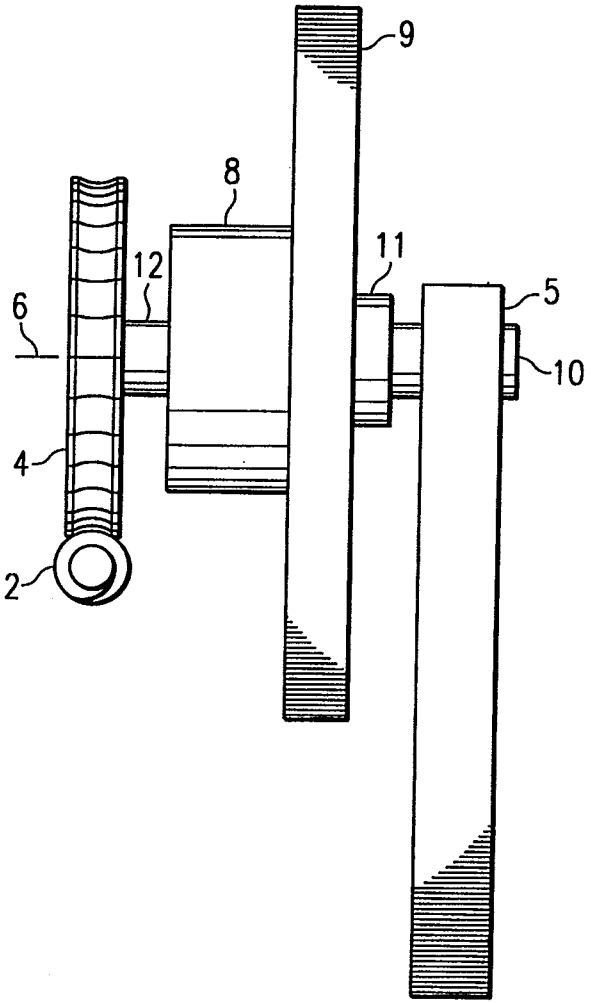
FIG. 2 is a schematic representation of another combination of basic elements employed in the various embodiments of the invention.

Referring to FIG. 2, a different view of a mechanism similar to that of FIG. 1 where the addition of an electromechanical clutch is shown, FIG. 2 depicts the worm drive 2, the worm gear 4, connected to a shaft 12 coupled to an electromechanical clutch 8 mounted on plate 9. The member 5 is mounted on a shaft 10 which is connected through the mounting plate 9 into the clutch 8. A rotational encoder 11 is coupled with the shaft 10 and to a suitable readout, not shown, to provide the user with the angular position of the member 5. The electromechanical clutch 8 is connected with a suitable switch or button which can turn off the clutch and disconnect the shaft 12 from the shaft 10 so that the member may move freely independant of the worm gear. The clutch acts as a safety device, so that the user may instantly stop motion of the member 5 in the event that the arm, leg or other body member of the user is moved by the member 5 to an unacceptable position. In the event of loss of power the clutch will be de-energized and the shafts disconnected.

The mechanisms of FIGS. 1 and 2 may be used in a variety of exercise devices for moving various body members of a user in accordance with the invention.

Figure 3B:
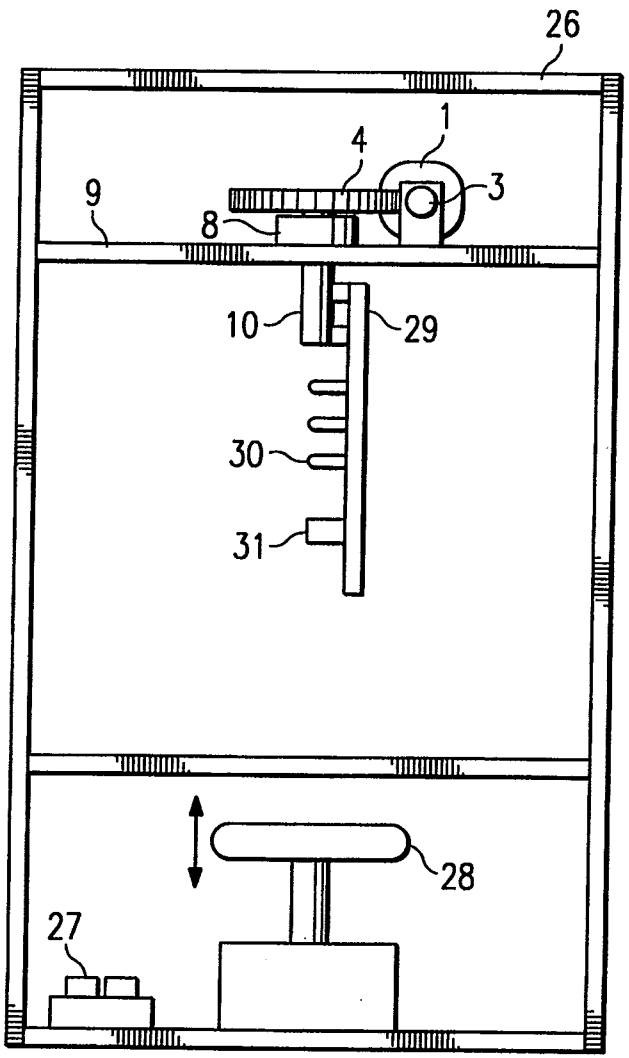
FIG. 3B is a side schematic view of the device of FIG. 3A.
Figure 3A:
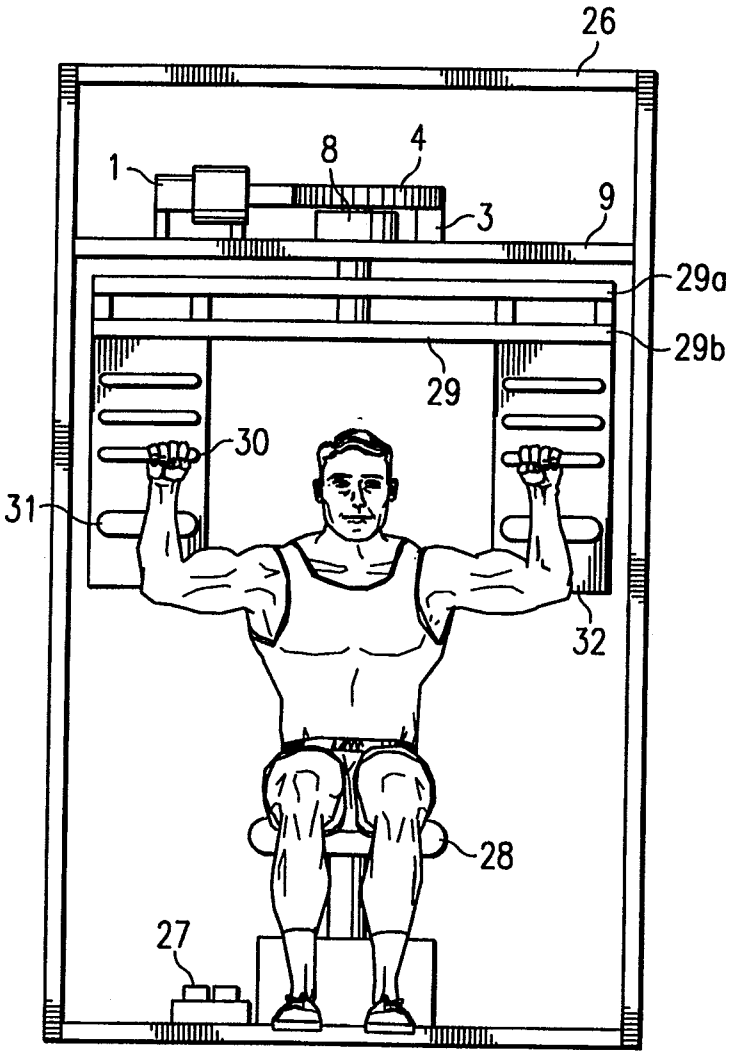
FIG. 3A is a front schematic view of an exercise device of the invention for upper torso rotation.

FIGS. 3A and 3B illustrate the application of the mechanism of FIG. 2 to an exercise device for rotation of the upper torso of the user about the spine of the user. The rotation is effected by utilizing the device of the invention to rotate the shoulders in a horizontal plane perpendicular to the spine of the user for rotating the upper torso about the spine. Referring to FIGS. 3A and 3B, a frame 26 supports the mounting plate 9 in a horizontal plane. The mechanism illustrated in FIG. 2 is supported on the mounting plate including the motor 1, the worm gear 4, the worm gear bearing 3, and the electromechanical clutch 8. The gear motor 1 drives the worm gear 4 and so rotates the shaft 10 when the clutch 8 is energized. A restraining brace 29 is connected with the shaft 10 and includes horizontal members 29*a* and 29*b* supporting vertical arm panels 32. The arm panels are in parallel spaced relationship pendant from the horizontal braces. Each of the arm panels has vertically spaced hand grips 30 and adjustable arm straps 31. The panels 32 are horizontally spaced substantially the distance between the elbows and arms of an average user when the upper arms of the user are horizontal and the lower arms vertically upward and aligned along the approximate center line of the panels 32. A foot control switch 27 including a motor controller, such as the controller 7 of FIG. 1, and an emergency switch for decoupling the clutch 8 is mounted on the floor of the frame 26 adjacent to one of the feet of the user. An adjustable seat 28 is provided on the floor beneath and approximately midway between the arm panels 32.

A user of the upper torso rotation exercise device of FIGS. 3A and 3B sits on the seat 28 in the position illustrated in FIG. 3A. The seat is adjusted to a height at which the user may extend the upper arms straight outwardly to opposite sides aligned in a horizontal axis in a plane with the shoulders and perpendicular to the spine so that the elbows of the user are approximately at the bottom of the panels 32. The lower arms of the user are extended vertically upward from the elbows with the adjustable straps 31 holding the arms against the panels 32 while the hands of the user grip the appropriate hand grips on the panels as illustrated. The users right foot operates the control 27 to pivot the restraining brace 29 on the shaft 10 sequentially rotating the arms and upper torso in either desired direction and as far the user desires. The torso is rotated in continuous steps until a point is reached at which further motion would result in pain. When the rotating motion of the exercise device is stopped the arm panels 32 with the coupled arms of the user remain locked in position. Thus, a rigid barrier is provided the user against which the user may contract, sequentially, antagonist and the agonist muscle groups. Repeating such efforts will relax the antagonist, permitting the user to move the exercise device by means of the control 27 in small increments to a greater degree of stretch where the process of contraction of the two muscle groups is repeated. If at any time the user feels too much discomfort, the clutch 8 may be de-energized at the control 27 so that the user may return the arms to a more natural position at which the torso is less trained.

Figure 4:
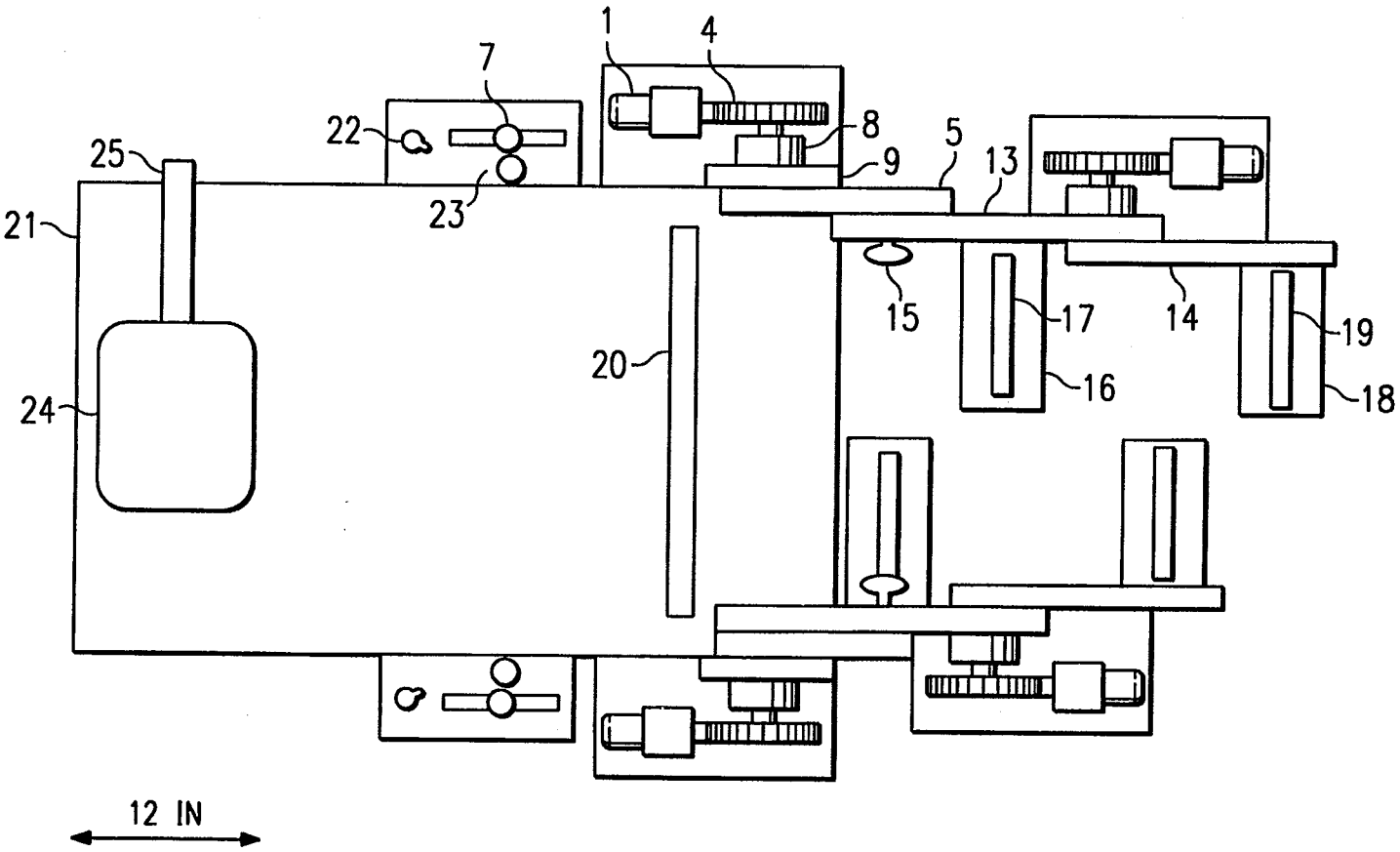
FIG. 4 is a top plan view of a combination hip and knee flexion exercise device in accordance with the invention.
Figure 5:
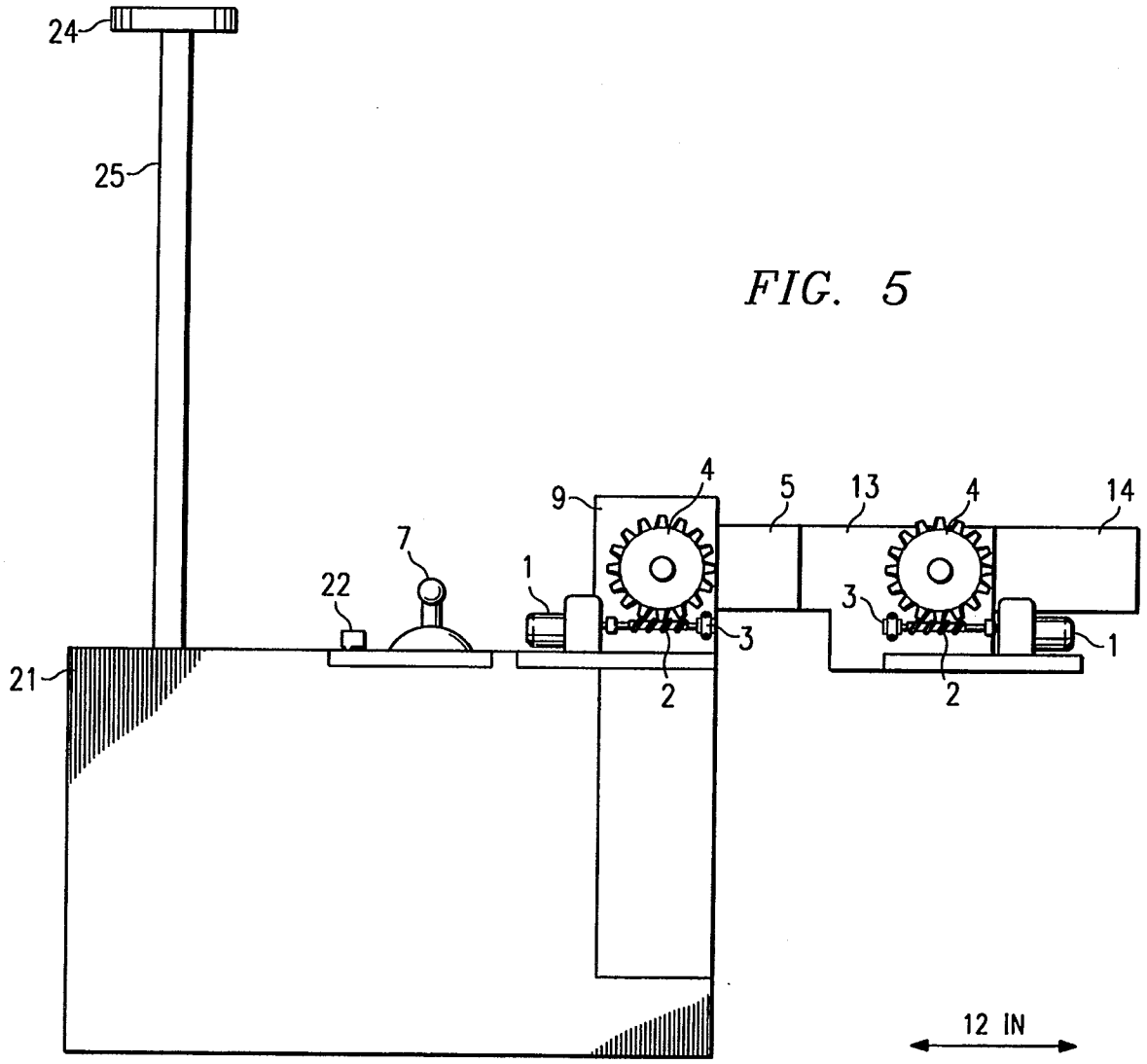
FIG. 5 is a side schematic view of the device of FIG. 4

FIGS. 4 and 5 illustrate the application of the invention to a combination hip and knee flexion exercise machine. Four independently controlled rotational mechanisms as illustrated in FIG. 2 are mounted in relation to a body support or base 21. One of the mechanisms is provided for each hip and for each knee joint of the user. Each of the mechanisms includes a gear motor 1, a driving worm 2, and a worm gear 4. The hip joint rotational mechanism is mounted on a support plate 9 and moves a plate 5. A plate 13 is attached to the plate 5 by a screw-down knob 15 which passes through a slot in the plate 13 to allow the plate to slide with respect to the plate 5 and be locked in a desired position relative to the plate 5. An upper leg restraint 16 with a strap 17 is attached to the plate 13. A knee joint rotational mechanism is attached to the plate 13 operating a plate 14 to which is secured a lower leg restraint 18 having a restraining strap 19. The sliding movement of the plate 13 with respect to the plate 5 permits the adjustment of the axis of rotation of the hip and knee joint mechanisms to be adjusted to match the axes of rotation of different users hip and knee joints. When hip and knee joint mechanisms are properly adjusted for the spacing between the users hip joint and the users knee joint, the users lower legs are strapped to the plates 18 by the straps 19 and the users upper legs are strapped to the plates 16 by the straps 17. The user reclines on the base 21 securing the strap 20 across the midsection of the user above the hips. A gear motor control unit 7 on each side of the user is operated by each hand of the user to control the hip and knee mechanisms. A switch 22 on each of the control unit panels allows the user to select between the hip mechanism and knee mechanism on that side of the machine. A display panel 24 mounted on post 25 above the user is connected with rotational encoders on each of the mechanisms allow the user to observe the angular position of each of the users joints coupled to each hip and knee mechanism. Exercising using this hip and knee flexion device involves the motion of only one joint at a time. Operating on one leg or the other, the user moves the knee joint to some selected angle, changes the switch 22 to the hip flexion mode and performs PNF exercises for hip flexion. Alternately, the hip angle may be fixed and the PNF exercise may be carried out on the knee flexion.

Figure 6A:
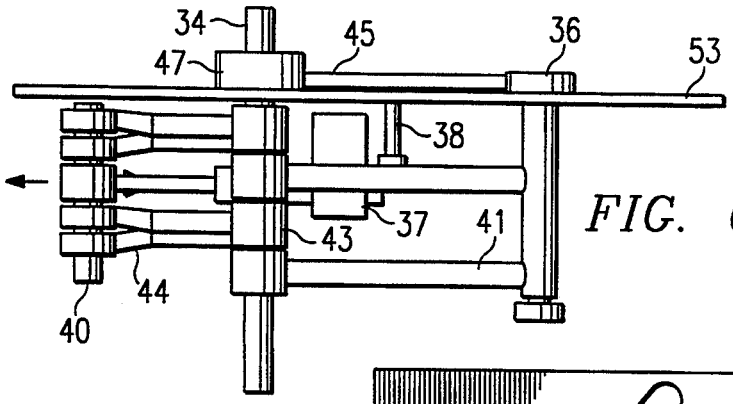
Figure 6B:
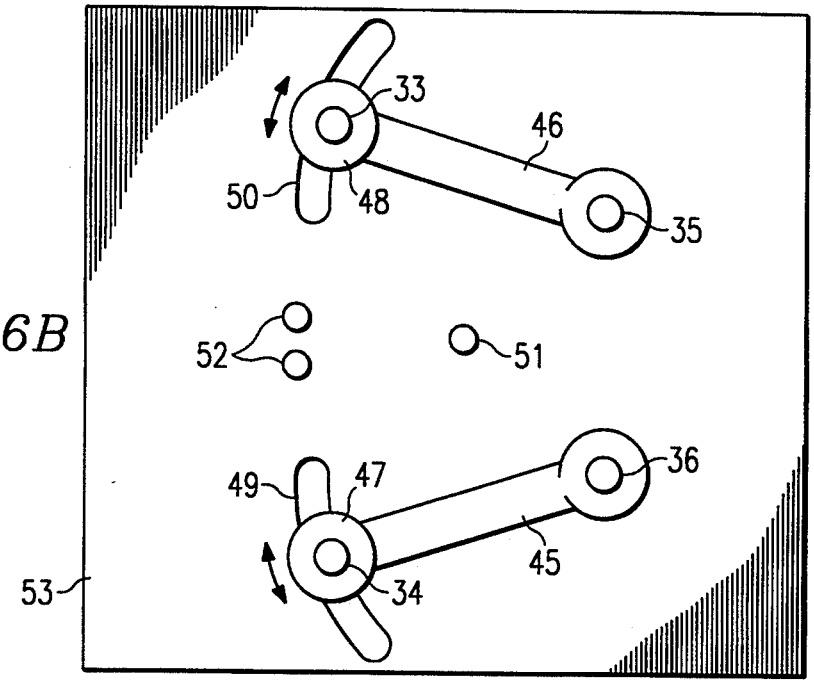
FIG. 6B is a top view of the device of FIG. 6A.
Figure 6C:
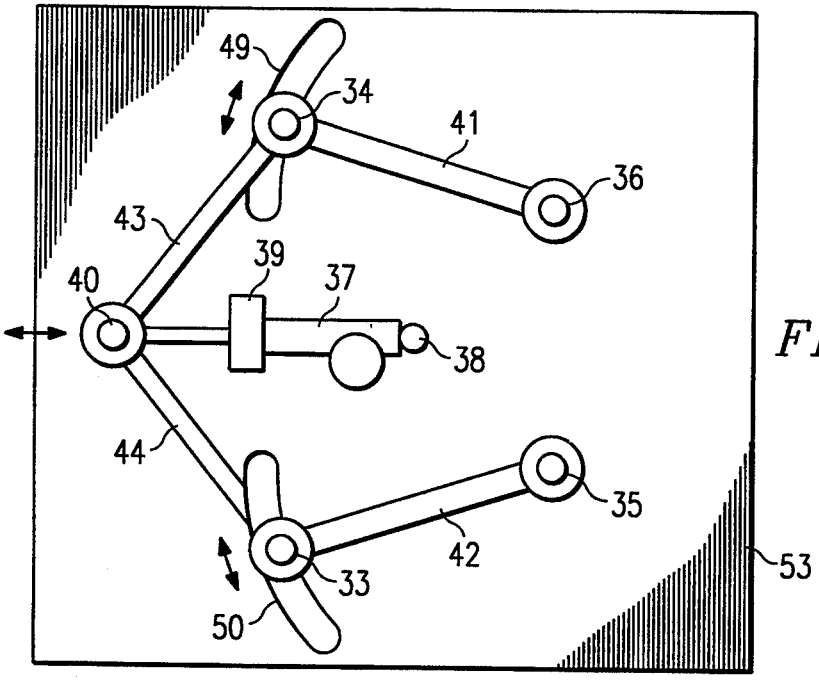
FIG. 6C is a bottom view of the device of FIG. 6A.
Figure 7A:
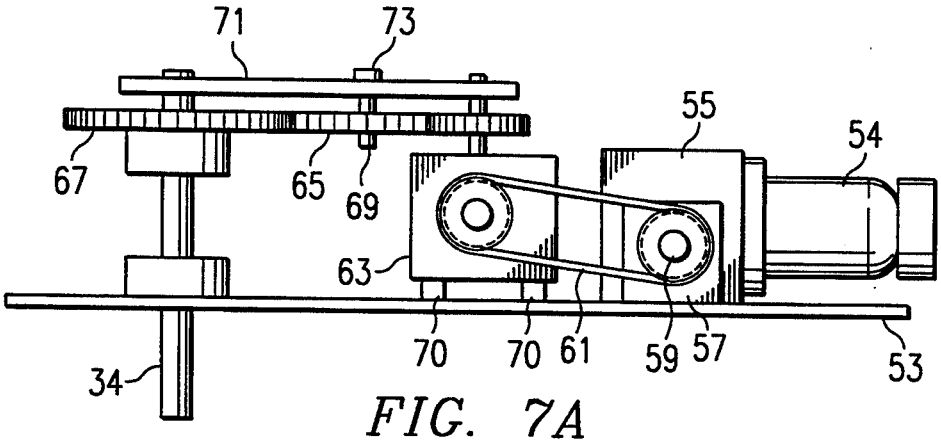
FIG. 7A is a side view of the drive mechanism for the device shown in FIG. 6A.
Figure 7B:
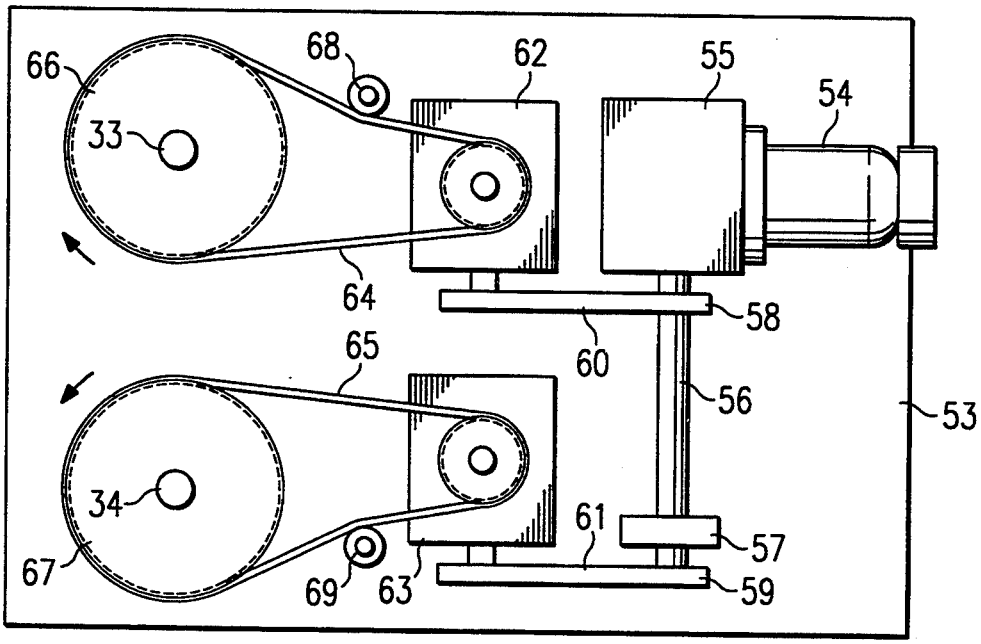
FIG. 7B is a top view of the mechanism shown in FIG. 7A.
Figure 7C:
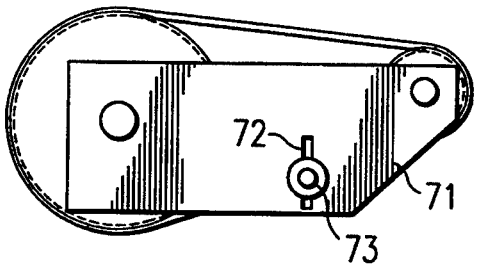
FIG. 7C is a top view of a portion of the mechanism of FIG. 7B illustrating the tension adjustment for one of the drive shafts of the mechanism of FIG. 7B.
Figure 8:
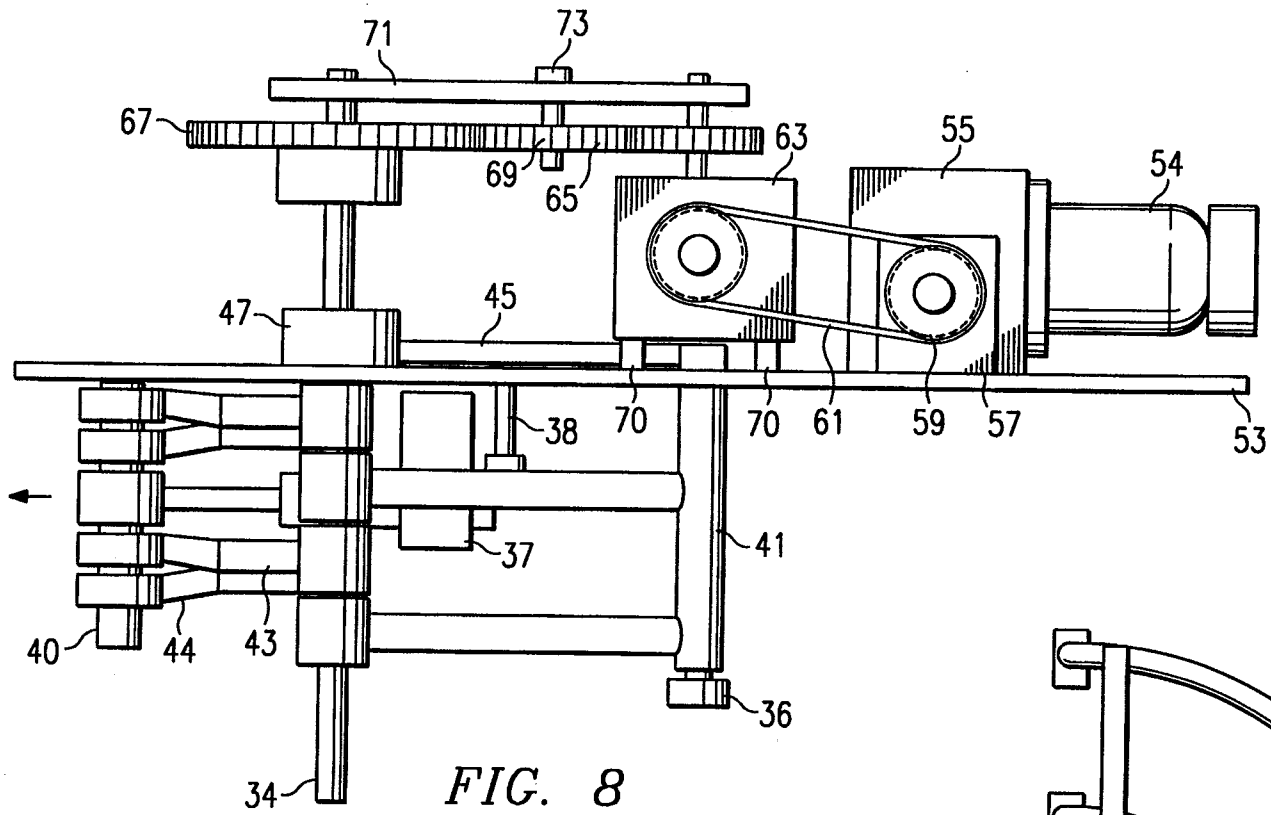

FIGS. 6A–8 illustrate the application of the invention to the use of two mechanisms essentially similar to FIG. 2 wherein two vertical shafts are driven from a common power source with the shafts being laterally adjustable to vary the distance between the shafts. The application of such mechanism to an exercise device is illustrated in FIGS. 9 and 10A–10C for exercising the two arms of a user simultaneously rotating the upper and lower arms in an horizontal outstretched position relative to the shoulder joints. Reference is made to FIGS. 6A–C illustrating the linkage arrangement for varying the distance between the vertical drive shafts. Horizontally spaced pivot bearings 35 and 36 are attached to a mounting plate 53. Brackets 45 and 46 are connected on the bearings 35 and 36 above the mounting plate and, similarly, brackets 41 and 42 are attached to the bearings 35 and 36 below the mounting plate. Vertical rotatable shafts 33 and 34 are attached to bearings at the ends of brackets 41 and 43 and 42 and 44, respectively, below the plate 53. Above the plate 53, the shafts 33 and 34 are mounted in bearings 48 and 47, respectively, at the ends of brackets 46 and 45. The ends of the brackets 44 and 43 meet at a common point connected with bearings on a vertical shaft 40. A linear actuator 37 is mounted to the plate 53 by fittings 38 and 39 secured with the plate 53 at mounting holes 51 and 52. The linear actuator 37 operates the vertical shaft 40 along a horizontal line midway between the shafts 33 and 34 and perpendicular to a line between the shafts as represented in 6C. This linear motion of the shaft 40 drives the brackets 43 and 44 causing the brackets 41 and 45 and 42 and 46 to pivot about the bearings 35 and 36 spreading the shafts 33 and 34 apart or moving the shafts together depending upon the direction of motion imparted from the linear actuator 37. FIGS. 7A, 7B and 7C illustrate the drive mechanism used with the apparatus of FIGS. 6A–6C for rotating the shafts 33 and 34. A reversible motor 54 drives a gear reducer 55. The output shaft 56 from the gear reducer is supported at a bearing 57 mounted on the plate 53. Sprockets 58 and 59 are mounted on the shaft 56. The sprockets 58 and 59 are coupled by chains 60 and 61 with gear reducers 62 and 63. The gear reducers are designed to drive the output shafts in opposite directions for rotation of the shafts 33 and 34 in opposite directions. The gear reducers must be designed for opposite direction output because the input drive to the reducers comes from a single shaft, and thus, the input of the reducers is turned in the same direction. The gear reducer 62 and 63 drive the chains 64 and 65, respectively, which turn the sprockets 66 and 67 connected to the drive shafts 33 and 34. Tension adjustment sprockets 68 and 69 operate with the chains 64 and 65, respectively. FIG. 7C shows support mechanism for the sprocket 69. A plate 71 is mounted above the sprocket 67. The sprocket 69 is mounted on a shaft supported through a slot 72 in the plate 71 to permit adjustment of the position of the sprocket 69 relative to the chain 65. A lock nut 73 tightens on the shaft to hold the sprocket 69 at the desired position. The same mounting arrangement for the sprocket 68 is supported above the sprocket 66. The output shafts of the gear reducer 62 and 63 are aligned with the fixed shafts 35 and 36 supporting the brackets 41 and 42 so that as the shafts 33 and 34 are moved together and apart, the tension in the chains 64 and 65 is not changed. The gear reducers 62 and 63 are supported on feet or spacers 70 on the panel 53 to provide clearance for the pivoting brackets 45 and 46 on the top side of the plate 53.

Figure 10C:
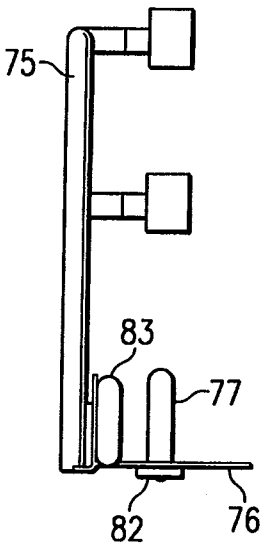
FIG. 10C is a right end view of the arm restraint bracket as illustrated in FIG. 10B.
Figure 10B:
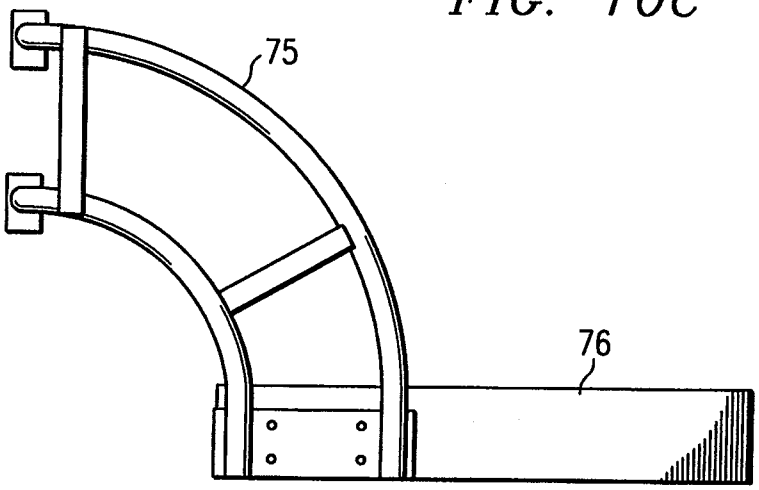
FIG. 10B is a side view in elevation of the arm restraint bracket of FIG. 10A.
Figure 10A:
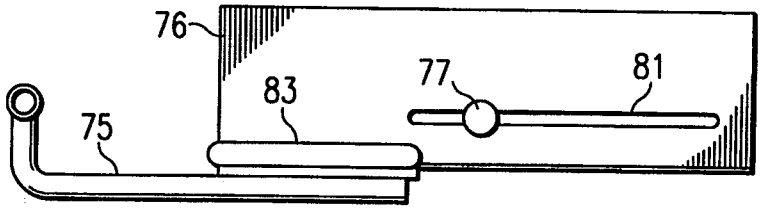
FIG. 10A is a top view of one of the arm restraint brackets of the device of FIG. 9.
Figure 9:
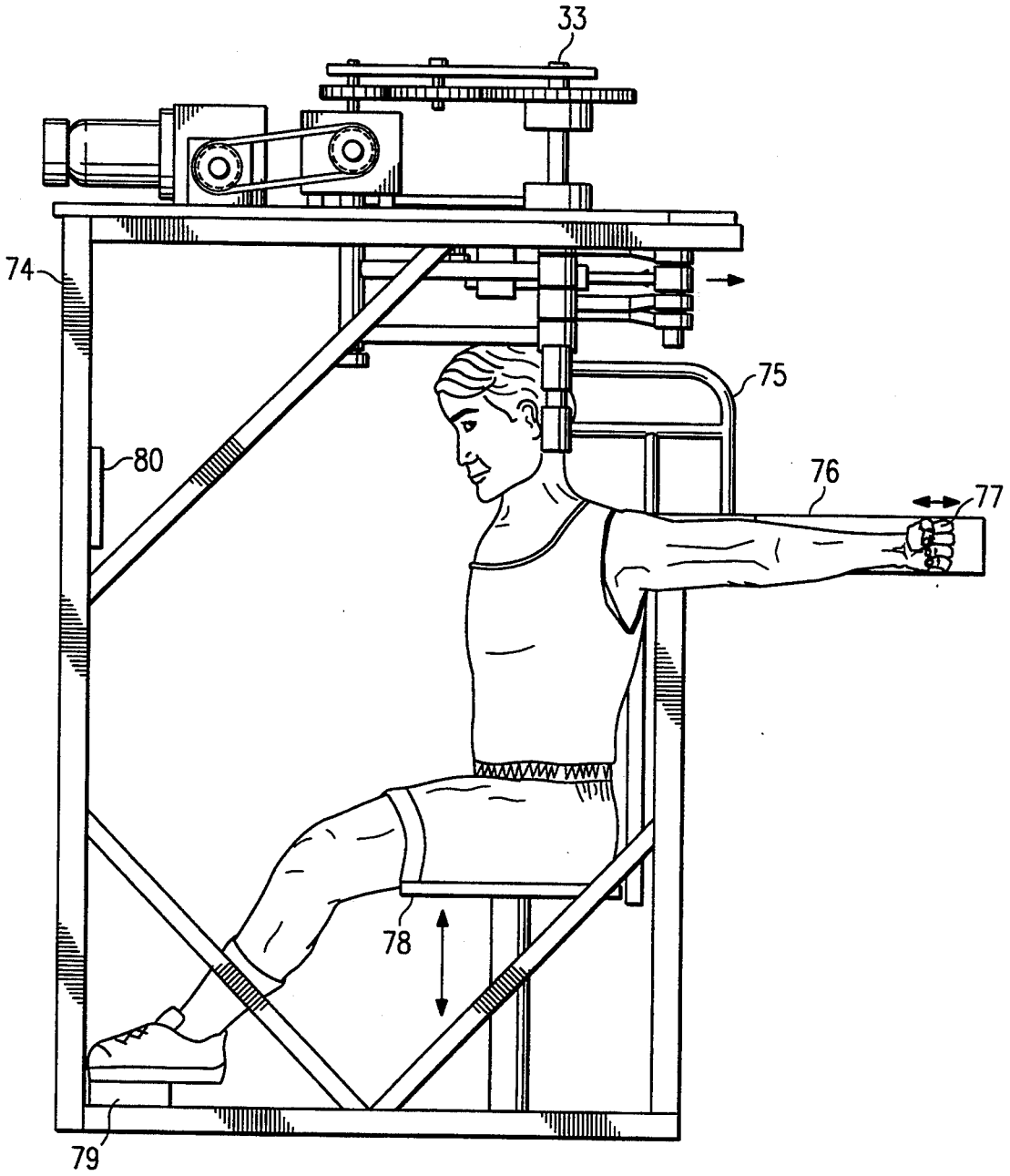
FIG. 9 is a schematic side view of an exercise device in accordance with the invention utilizing the mechanism of FIG. 8.

The mechanisms of FIGS. 6A–8 are used in a shoulder horizonal rotation machine illustrated in FIGS. 9, and 10A–10C. This device provides for rotation or pivotal movement of a user's arms from the shoulder joint in a horizontal plane through the shoulder joints because of the rotation of the vertical parallel adjustable shafts 33 and 34. Referring to FIG. 9, a frame 74 supports the two coordinated axes mechanisms above a seat 78 for the user. Two arm restraint brackets 75 are mounted in vertical lateral spaced relation, one each supported from each of the shafts 33 and 34 as seen in FIG. 9. Each of the restraint brackets has an arm restraint 76 provided with a hand grip 77 which slides in a slot 81. The hand grip may be locked in position along the slot by a locking nut 82. A pad 83 is mounted on the arm restraint 76 at the front face of the bracket 75 as seen in FIGS. 10A and 10C.

A user of the device of FIGS. 9 and 10A–10C using the parallel drive shaft mechanisms of FIGS. 6A–8, is seated on the adjustable seat 78. The parallel shafts 33 and 34 are adjusted by means of linear actuator 37 to position each shaft, and thus, the upper end mounting of the restraint brackets 75 which rotate about shafts 33 and 34, are in line with the users two shoulder joints. The arms of the user are each placed on one of the arms restraints 76 with the back of the upper arm resting against the pad 83 and the hand gripping the hand grip 77 which is adjusted by the nut 82 to a proper position along the slot 81 for comfortable gripping by the user hand. A foot switch motor control 79 is mounted on the base of the frame 74 electrically coupled with the operating mechanism for controlling the rotation of the shafts 33 and 34 in opposite directions. A readout 80 is connected with the mechanism to provide the user with the angular position of each of the brackets 75, and thus, the arm of the user. Using the foot control the user may incrementally rotate the brackets 75, and thus, the arms of the user rearwardly until positions of discomfort are reached. Stopping of the motion of the shafts locks the arm restraints at a desired position at which the user may try to bring the arms backwardly or forwardly. The arms may be incrementally moved rearwardly as far as the user can tolerate with efforts at each position being made to bring the arms forward and backward, thus, performing the desired PNF exercise of the arms.

It will be apparent to those skilled in the art that the electric motors, worm gears and related parts illustrated and described to produce the desired motions are only one of numerous combinations of apparatus which may be used in the invention. Pneumatic, hydraulic, and even the muscles of the user may be the power source which may be coupled to chain, belt, or cable drives.

It will now be seen that new and improved exercise devices have been described and illustrated utilizing the general concept mechanizing PNF exercising. A general rotating mechanism which can be applied to exercises requiring only one axis of rotation has been described and illustrated. An exercise machine utilizing multiple axes which are independently controlled, such as a machine which performs a combination of hip and knee flexion, has been described and illustrated. An exercise device using two axes of rotation with an adjustable separation between the axes and coordinated motion of the shafts has been described and illustrated for performing horizontal rotation of the shoulder joints. It will be apparent that other combinations of the disclosed devices may be made for performing a variety of PNF exercises.

The types of machines described herein will produce better results than any method of increasing flexibility yet devised because they will permit a superior method of executing PNF techniques. Adjustable body positioners and restraints will permit better isolation of motion to work on specific body parts. This degree of isolation is not possible even with the help of a therapist. The movement of the body in small increments is totally controlled by the user rather than another individual. The user can determine his maximum comfortable limit of stretch better than anyone else. A machine is able to provide much more rigid restraints against which the user may contract agonist and antagonist muscle groups than is humanly possible. The user can therefore apply maximum effort without fear of the hold of the therapist being overcome or having the therapist overreact and possibly cause injury by exceeding a safe limit of stretch. Because the release mechanism is controlled by the user, who knows his or her own limits better than anyone, potential for injury is minimized. The direct readout of the degree of stretch will permit positive feedback to the user and permit him to know and record his progress in quantitative terms.

What is claimed is:

1. An stretching device, comprising:

a fixed attachment station, configured to provide a fixed rest point for a first portion of a user's body when the user's body is stationed in a substantially predetermined position;

a movable member, connectable to define the rotational position of a predetermined joint of the user's body while the user's body is stationed in said substantially predetermined position, said movable member having a first restraint, positioned to withstand pressure from an agonist muscle of the predetermined joint, and a second restraint, positioned to withstand pressure from a corresponding antagonist muscle of the predetermined joint, said movable member being connected to a drive motor which can incrementally change the position of said movable member around an axis of rotation, said axis of rotation being aligned with the axis of rotation of the predetermined joint while the user's body is in said predetermined position; and a control station, electrically connected to control the incremental motion of said drive motor, and physically located to be accessible to the user while the user's body is stationed in said substantially predetermined position; wherein said control station includes a quick-release control which, when activated, immediately releases resistance to the movement of the predetermined joint;

whereby the user can operate said control station to incrementally change the position of said movable member, while the user's body remains in said substantially predetermined position.

2. The stretching device of claim 1, wherein said motor is a gearmotor.

3. The stretching device of claim 1, wherein said movable member is connected to said drive motor through a linkage which includes a normally-off electromechanical clutch.

4. The stretching device of claim 1, wherein the first portion of a user's body includes the midsection thereof.

5. The stretching device of claim 1, wherein said control station is position to be controllable by a user's foot.

6. The stretching device of claim 1, wherein said movable member is adjustable to assure alignment of axis of rotation thereof with the axis of rotation of the predetermined joint.

7. The stretching device of claim 1, wherein said movable member constrains rotation of the predetermined joint to motion within a predetermined plane.

8. The stretching device of claim 1, wherein the predetermined joint is a shoulder joint.

9. A stretching device, comprising:

a fixed attachment station, configured to provide a fixed rest point for a first portion of a user's body when the user's body is stationed in a substantially predetermined position;

a first movable member, connectable to define the rotational position of a first predetermined joint of the user's body while the user's body is stationed in said substantially predetermined position, and a second movable member, connectable to define the rotational position of a second predetermined joint of the user's body while the user's body is stationed in said substantially predetermined position, said movable members each having a respective first and second restraints, positioned to withstand pressure from both agonist and antagonist muscles of the first and second predetermined joints, said movable members each being operatively connected to a drive motor which can incrementally change the position of said respective movable member around a respective axis of rotation thereof, said respective axis of rotation being aligned with the axis of rotation of the predetermined joint while the user's body is in said predetermined position; and a control station, electrically connected to control the incremental motion of either of said movable members, and physically located to be accessible to the user's body is stationed in said substantially predetermined position; wherein said control station includes a quick-release control which, when activated, immediately releases resistance to the movement of the predetermined joint;

whereby the user can operate said control station to incrementally change the position of said movable member, while the user's body remains in said substantially predetermined position.

10. The stretching device of claim 9, wherein said movable members are adjustable to assure alignment of the axes of rotation thereof with the axes of rotation of the predetermined joints.

11. The stretching device of claim 9, wherein the first and second predetermined joints are left and right shoulder joints respectively.

* * * * *